United States Patent [19]

Rayle et al.

[11] 4,041,868

[45] Aug. 16, 1977

[54] THIN WALLED STEEL CARTRIDGE CASE

[75] Inventors: Roy E. Rayle, Waukesha; Robert J. Brey, Greendale; Wilbur John Woodruff, Waukesha, all of Wis.

[73] Assignee: Amron Corporation, Waukesha, Wis.

[21] Appl. No.: 655,634

[22] Filed: Feb. 5, 1976

[51] Int. Cl.[2] ..... F42B 9/28

[52] U.S. Cl. ..... 102/43 F; 75/123 R

[58] Field of Search ..... 102/38, 43 R, 43 F, 102/44; 75/123 R, 123 B; 42/16

[56] References Cited

U.S. PATENT DOCUMENTS

| | | | |
|---|---|---|---|
| apc340,193 | 5/1943 | Landbeek | 102/43 R |
| 1,296,842 | 3/1919 | Offuth et al. | 102/43 F |
| 2,193,245 | 3/1940 | Buxton | 102/43 F |
| 2,774,283 | 12/1956 | Harvey | 42/16 X |

OTHER PUBLICATIONS

*Steel and its Heat Treatment* vol. I by Bullens, John Wiley & Sons Table II XXI-XXIII.

*Primary Examiner*—Harold Tudor

*Attorney, Agent, or Firm*—Andrus, Sceales, Starke & Sawall

[57] ABSTRACT

A thin walled steel cartridge case having a substantially larger internal volume than a conventional cartridge case. The cartridge case is fabricated from a high strength, heat treated carbon steel or boron steel and the wall contour in the head area is designed to avoid localized high stress. A low friction coating is applied to the outer surface of the cartridge case and serves to reduce stress concentrations in the head area and to reduce extraction force in the event of interference between the case and the chamber during extraction.

8 Claims, 4 Drawing Figures

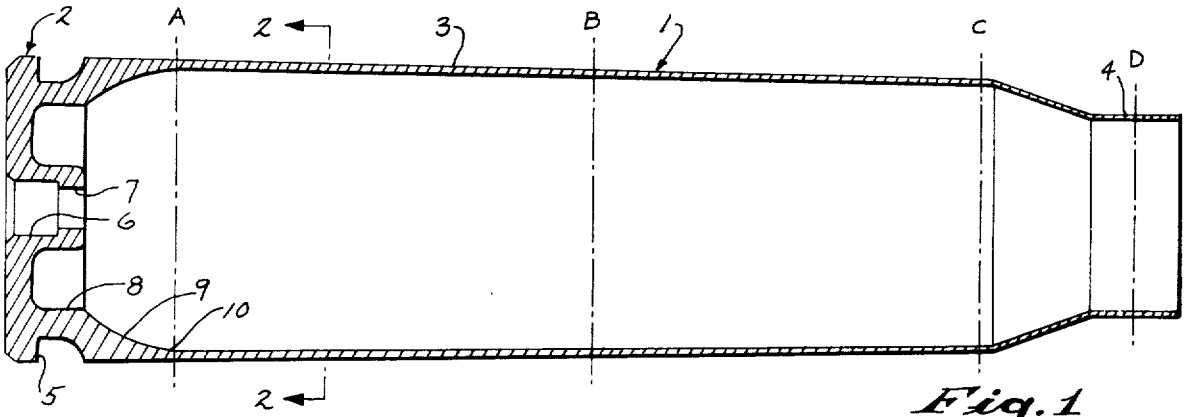
Fig. 1
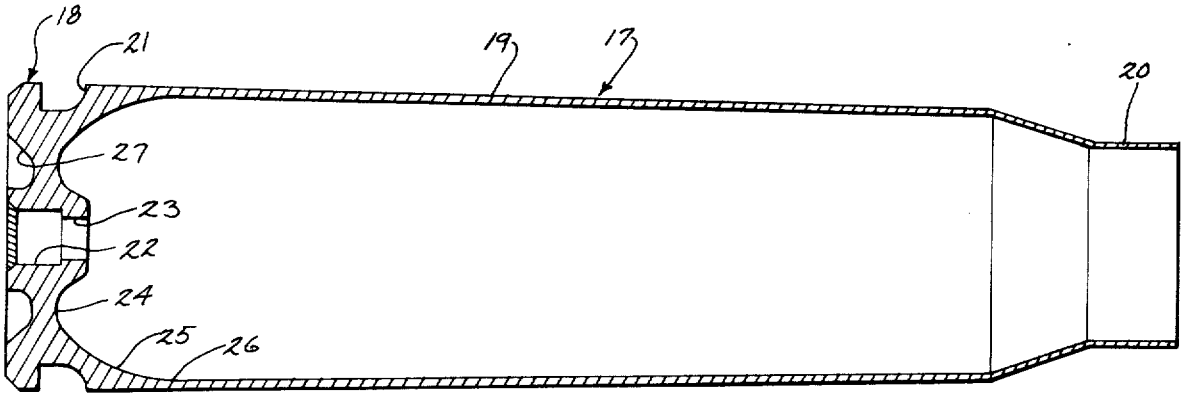
Fig. 3
Fig. 2
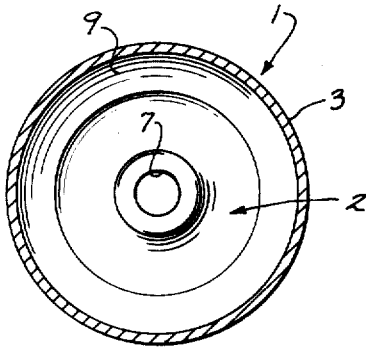
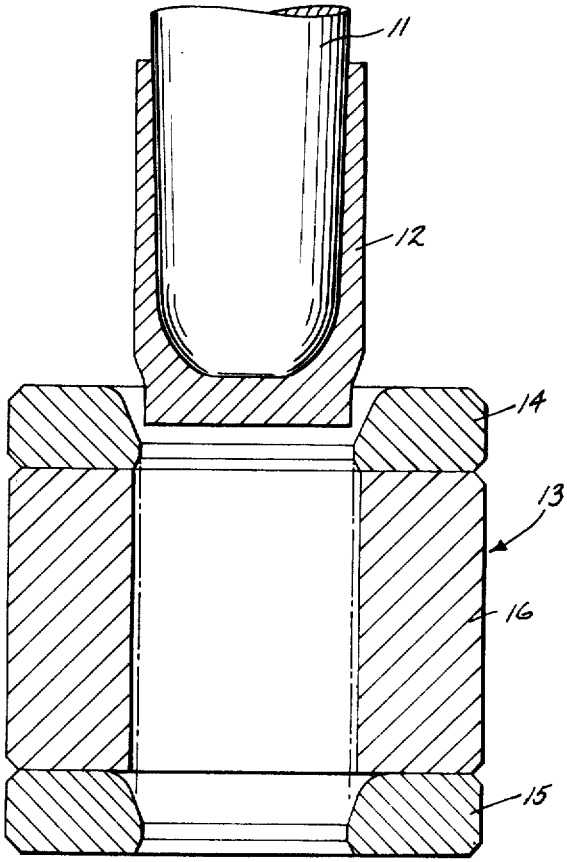
Fig. 4

THIN WALLED STEEL CARTRIDGE CASE

BACKGROUND OF THE INVENTION

In the past, high pressure cartridge cases, whether brass, steel or aluminum, have been characterized by thick metal sections in the head and relatively thick walls in order to withstand the high pressures, generally in the range of 50,000 to 70,000 psi, which are developed on firing. Because of the thick sections, the conventional brass or steel cartridge cases are relatively heavy, and aluminum cartridge cases for high performance guns are expensive due to the use of special aluminum alloys to provide adequate strength.

SUMMARY OF THE INVENTION

The invention relates to a thin walled, high pressure, steel cartridge case having a weight approximating that of an aluminum cartridge case, but having a substantially larger internal volume than a conventional cartridge case. The thin walled cartridge case is fabricated from a high strength, heat treated, boron steel or carbon steel, and the internal wall contour in the head is designed to avoid localized high stresses.

A low friction coating is applied to the outer surface of the cartridge case and serves to reduce stress concentrations in the head area and to reduce the extraction force in the event of interference between the case and the chamber during extraction.

Circumferential ruptures at the joint between the head and the wall, previously common in cartridge cases having localized thin wall sections, are avoided in the cartridge case of the invention by a combination of factors; namely, the steel composition, the design of the taper and the joint between the head and the wall, and the use of the low friction coating.

The cartridge case of the invention has a wall thickness approximately one-third the thickness of conventional steel cartridge case. Due to the thinner wall, the internal volume available for propellant is increased approximately 15% to 20% without significantly changing the outside contour or length of the cartridge case.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of a cartridge case made in accordance with the invention;

FIG. 2 is a section taken along line 2—2 of FIG. 1;

FIG. 3 is a longitudinal section of a modified form of the cartridge case of the invention; and FIG. 4 is a schematic view showing the die assembly used in drawing the cartridge case.

DESCRIPTION OF THE PREFERRED EMBODIMENT

FIGS. 1 and 2 illustrate a cartridge case 1 having a size generally in the range of 12 to 40 mm and including a head 2, a generally cylindrical wall section 3 and a mouth 4 of reduced diameter. As shown in FIG. 1, the head 2 is formed with a circumferential extraction groove 5, and a primer cavity 6 which communicates with an axial bore 7.

The inner surface of the head 2 is provided with a relatively deep annular groove 8, and a curved or arched surface 9 connects the groove to the wall section 3 at a radius indicated generally by 10.

In accordance with the invention, the cartridge case is fabricated from a high strength, heat treated boron steel or carbon steel. The boron steel composition in weight percent is as follows:

| | |
|---|---|
| Carbon | 0.18 - 0.23 |
| Manganese | 0.80 - 1.10 |
| Phosphorus | 0.03 max. |
| Sulfur | 0.04 max. |
| Silicon | 0.10 max. |
| Boron | 0.0005 - 0.003 |
| Iron | balance |

The above boron steel provides the desired characteristics of formability and hardenability in order to produce the thin-walled cartridge case. Due to the low carbon content, the steel is capable of being cold formed into the case configuration using existing manufacturing processes which are capable of producing high quality cartridge cases under high volume production conditions, and the addition of boron provides the steel with sufficient hardenability so that the case can be heat treated to the desired mechanical property levels using regular production techniques.

The carbon steel used to fabricate the cartridge case can have the following composition in weight percent:

| | |
|---|---|
| Carbon | 0.30 - 0.50 |
| Manganese | 0.80 - 1.10 |
| Phosphorus | 0.03 max. |
| Sulfur | 0.04 max. |
| Silicon | 0.10 max. |
| Iron | balance |

The cartridge case is fabricated by conventional methods using either a blank, cup and draw process, a cold extrusion draw and iron process, or a combination of these two processes. Stacked multiple draw rings, as illustrated in FIG. 4, can be utilized to provide the thin wall section. As illustrated in FIG. 4, a punch 11 carries the cupped workpiece 12 that was previously formed by a blank, cup and draw process, or a rod, extrude and draw process. The punch 11 forces the workpiece 12 through the draw ring assembly 13 which includes a series of draw rings 14 and 15 which are separated by spacers 16. The number of draw rings may vary from two to eight, depending on the desired cartridge case length and the stroke of the punch. The spacer 16 is designed for a very small clearance, less than 0.0004 inch between the internal surface of the spacer and the workpiece.

During fabrication, the workpiece is annealed between each cold working operation by heating to a temperature in the range of about 1200° F to 1400° F. The low carbon steel permits extensive cold forming operations between the anneals.

In order to achieve a high strength wall, heat treatment to high hardness levels in the range of 33 to 45 Rockwell C after drawing is required. To provide this hardness, the cartridge case is heated to a temperature in the range of about 1600° F to 1700° F, quenched as by quenching in brine, and tempered by reheating to a temperature in the range of about 500° F to 800° F. The boron enhances the hardenability so that hardness levels can be achieved which normally are obtainable only with appreciably higher carbon levels. The finished cartridge case has a tensile strength in the range of 150,000 to 215,000 psi.

The completed cartridge case has a wall thickness at the datum plane A adjacent the radius 10, as shown in FIG. 1, in the range of 0.0144 mm to 0.0195 mm per mm of caliber; a wall thickness at datum plane B, which is located midway between the ends of the cartridge case, of 0.0123 mm to 0.0166 mm per mm of caliber; a wall thickness at datum plane C which is located adjacent the end of the cylindrical wall section, of 0.0102 mm to 0.0135 mm per mm of caliber; and a wall thickness at datum plane D, which is located at the mouth 4, in the range of 0.0119 mm to 0.0152 mm per mm of caliber. The increased wall thickness in the mouth is to provide adequate projectile full forces.

As an example, a finished 30 mm cartridge case has a wall thickness of about 0.43 to 0.58 mm at the datum plane A, a wall thickness of 0.37 to 0.50 mm at datum plane B, a wall thickness of 0.30 to 0.41 mm at datum plane C, and a wall thickness of 0.36 to 0.46 mm at datum plane D.

After heat treatment to provide the required hardness, a corrosion resistant coating, such as an electrodeposited zinc coating, is applied to both the inner and outer surfaces of the cartridge case. Subsequently, a low frictional coating is applied to the outer surface of the cartridge case to reduce the coefficient of friction to a value below 0.12. The coating can take the form of a cured fluorocarbon resin, such as polytetrafluoroethylene. The low friction coating on the exterior surface of the case wall serves a dual function. It reduces localized stresses and eliminates possible rupture in the area of the radius 10 and also serves to reduce the force necessary to extract the case from the chamber in the event of slight interference between the case and the chamber.

The hardness of the cartridge case is sufficient to provide a tensile strength normally exceeding 165,000 psi, thereby assuring that after decrease of pressure from peak pressure following firing, residual clearance will be realized between the case and the chamber. The arched or curved surface 9 located inwardly of the extraction groove 5 tends to slightly straighten out as pressure is applied after firing. This slight movement of surface 9 has the beneficial effect of reducing stretch in the critical area 10 which is most likely to rupture under maximum head space conditions.

FIG. 3 illustrates a modified form of the invention in which the cartridge case 17 includes a head 18, a tapered wall section 19 and a mouth 20 of reduced diameter. The head 18 is provided with an extraction groove 21, a primer cavity 22 and a bore 23 which communicates with the primer cavity.

The inner surface of the head 18 is formed with a circumferential groove 24 which blends into the curved or arched surface 25 and the surface 25 joins the thin wall section 19 at a joint or radius indicated generally by 25. The outer surface of the head is provided with an annular lightening groove 27 which reduces the weight of the cartridge case.

Due to the thin wall section 3, which is approximately one-third the thickness of a conventional cartridge case, along with the internal groove 8, the interior volume of the cartridge case is substantially increased so that the case can contain approximately 15% to 20% more propellant than a conventional cartridge case without any significant change in the outside contour or length of the case. The internal volume of the design of FIG. 1 is slightly greater than that of FIG. 2, due to the internal groove 8.

Circumferential ruptures at the juncture or radius area 10, previously common for cartridge cases having thinner wall sections, are avoided by the combination of the high strength steel, the design of the wall contour in the area near the head, and the use of the low friction coating.

Various modes of carrying out the invention are contemplated as being within the scope of the following claims particularly pointing out and distinctly claiming the subject matter which is regarded as the invention.

We claim:

1. A thin walled steel cartridge case, comprising a head having a primer cavity, a hollow tapered thin wall section extending outwardly from the head and terminating in an open mouth, the inner surface of the head having an annular groove located concentrically of the primer cavity, and a generally curved outward diverging surface connecting the annular groove with the wall section, said case being formed of a steel having the following composition in weight percent:

| | |
|---|---|
| Carbon | 0.18 - 0.23 |
| Manganese | 0.80 - 1.10 |
| Phosphorus | 0.03 max. |
| Sulfur | 0.04 max. |
| Silicon | 0.10 max. |
| Boron | 0.0005 - 0.003 |
| Iron | balance. |

2. The cartridge case of claim 1, wherein the inner surface of the head has an axial projection, said annular groove surrounds said projection.

3. The cartridge case of claim 1, wherein the wall section at a transverse datum plane midway between the ends of the case has a thickness in the range of 0.0123 to 0.0166 mm per mm of caliber.

4. The cartridge case of claim 1, and including a low friction coating on the outer surface of said wall section.

5. The cartridge case of claim 4, wherein said coating is polytetrafluoroethylene.

6. A thin walled steel cartridge case, comprising an end head having an axial primer cavity, a hollow tapered wall section extending outwardly from the head and terminating in an open mouth of reduced diameter, the thickness of said wall section progressively decreasing in a direction from the head toward the mouth, the inner surface of said head having an annular groove located concentrically of the primer cavity, a generally curved surface connecting the outer periphery of the annular groove with said wall section at a juncture, said case being formed of steel having the following composition in weight percent:

| | |
|---|---|
| Carbon | 0.18 - 0.23 |
| Manganese | 0.80 - 1.10 |
| Phosphorus | 0.03 max. |
| Sulfur | 0.04 max. |
| Silicon | 0.10 max. |
| Boron | 0.0005 - 0.0030 |
| Iron | balance |

and a coating of a cured resin having a coefficient of friction less than 0.12 disposed on the outer surface of said wall section.

7. The cartridge case of claim 6, wherein said case has a hardness in the range of 33 to 45 Rockwell C and a tensile strength in the range of 150,000 to 215,000 psi.

8. The cartridge case of claim 6, wherein said wall section at a transverse datum plane adjacent said juncture has a thickness in the range of 0.0144 mm to 0.0195 mm per mm of caliber and said wall section at a transverse datum plane midway between the ends of the case has a thickness in the range of 0.0123 mm to 0.0166 mm per mm of caliber, and said wall section at a transverse datum plane adjacent the mouth has a thickness in the range of 0.0102 mm to 0.0135 mm per mm of caliber.

* * * * *